US005600935A

United States Patent [19]

Isani et al.

[11] Patent Number: 5,600,935

[45] Date of Patent: Feb. 11, 1997

[54] MACHINE FOR PACKAGING FRAGILE CYLINDRICAL PRODUCTS, PARTICULARLY CIGARETTES OR SIMILAR

[75] Inventors: Gianfranco Isani, Caluso; Valter Spada, Marzabotto, both of Italy

[73] Assignee: SASIB S.p.A., Bologna, Italy

[21] Appl. No.: 504,572

[22] Filed: Jul. 20, 1995

[30] Foreign Application Priority Data

Aug. 5, 1994 [IT] Italy ..... GE94A0094

[51] Int. Cl.[6] ..... B65B 11/30; B65B 19/22

[52] U.S. Cl. ..... 53/234; 53/228

[58] Field of Search ..... 53/234, 232, 228, 53/233, 466, 230, 590

[56] References Cited

U.S. PATENT DOCUMENTS 4,574,562 3/1986 Cavazza ..... 53/234 X
4,918,901 4/1990 Gamberini et al. ..... 53/234
5,177,933 1/1993 Boriani et al. ..... 53/234
5,457,932 10/1995 Spada et al. ..... 53/234
5,533,323 7/1996 Osti et al. ..... 53/234 X

*Primary Examiner*—James F. Coan
*Attorney, Agent, or Firm*—Larson and Taylor

[57] ABSTRACT

A machine for packaging fragile cylindrical products, particularly cigarettes or similar, has means for feeding ordered groups of cigarettes, means of transferring the ordered groups of cigarettes to a station for joining to a wrapping slip, means of picking up and positioning the slip and means of introducing the groups of cigarettes together with the associated slip into a cell in a folding drum. According to the invention, the means of collecting and positioning the slips consist of pairs of gripping suction fingers which are made to rotate in a circular movement about an axis parallel to the axis of the folding drum. The gripping fingers grip each slip along the lateral surfaces at its corner areas. The means of transferring the groups of cigarettes to the joining station are made in such a way that the transfer movement is at least partially rectilinear.

20 Claims, 7 Drawing Sheets

MACHINE FOR PACKAGING FRAGILE CYLINDRICAL PRODUCTS, PARTICULARLY CIGARETTES OR SIMILAR

BACKGROUND AND SUMMARY OF THE INVENTION

The invention relates to a machine for packaging fragile cylindrical products, particularly cigarettes or similar, comprising:

- a unit for feeding a succession of ordered groups of cigarettes;
- a drum for folding wrapping slips around a group of cigarettes, this drum being provided with at least one and preferably more peripheral cells, each of which houses one group of cigarettes and has a peripheral opening for the insertion of a group of cigarettes;
- a station for joining a wrapping slip to a group of cigarettes, in which station the group of cigarettes is disposed in a position coinciding with and in front of the open side of the associated cell and the wrapping slip is interposed between the open insertion side of the cigarette-carrying cell and the facing side of the group of cigarettes;
- means of collecting the wrapping slip and positioning it in a predetermined position, substantially parallel to the facing sides of the group of cigarettes and of the cigarette-carrying cell;
- means of gripping the group of cigarettes and inserting it, together with the wrapping slip, into the cigarette-carrying cell;
- means of transferring the group of cigarettes from the unit for feeding the succession of groups of cigarettes to the station for joining them to the wrapping slips;
- means of synchronized operation of the said feed unit and the said collecting/positioning, gripping/inserting and transferring means.

The object of the invention is to provide a packaging machine of the type described initially, in such a way that a high operating speed can be provided without the necessity of excessively large drive motors, while ensuring simpler and less costly construction and reliable operation, with the reduction of the inertial masses and the feed movements for transferring the ordered groups of cigarettes and allowing a greater and more rapid adaptability of the machine to the different standard dimensions of cigarettes and of the ordered groups of cigarettes.

The invention achieves the objects stated above with a packaging machine for fragile cylindrical products of the type described initially, in which:

- the means of collecting and positioning the wrapping slips have at least two pairs of gripping suction fingers which are supported movably together along an annular path about at least one axis parallel to the axis of the folding drum, and which have a fixed relative disposition such that each of them interacts with one lateral face of the slip at one of the front and rear ends of the slip with respect to the direction of movement of the fingers along the annular path;
- the means of transferring the cigarettes from the feed unit to the joining station are made in such a way that the transfer path of the groups of cigarettes is at least partially rectilinear.

In one embodiment, the rectilinear transfer path of the groups of cigarettes is transverse with respect to the axis of the path of the gripping suction fingers, and is a secant of this axis.

According to a further characteristic, the gripping fingers are fitted on guide and support means which laterally surround an intermediate transfer channel interposed between the fingers associated with the two opposite lateral strips of the wrapping slips; this transfer channel opens onto the open insertion sides of the cigarette-carrying cells at the joining station, and is orientated in the direction of insertion of the groups of cigarettes together with the wrapping slips into the said cells, while the transfer channel is associated with linear transfer elements which are moved along the said transfer channel, with a reciprocating motion along an annular rectangular path, in other words with rectilinear transfer and return movements and transverse raising and lowering movements.

The rectilinear transfer path of the groups of cigarettes is advantageously coplanar, and laterally out of alignment, with the transport path of the groups of cigarettes on the feed unit, pushing means being provided to move the groups of cigarettes from the discharge end of the feed unit to the entry end of the transfer channel along a path transverse with respect to the transfer channel and to the direction of transport of the cigarettes on the feed unit.

The entry end of the transfer channel is disposed substantially in the median area of the annular path of the gripping fingers, the guide and support means of the gripping fingers consisting, at least on the side facing the feed unit, of an annular member coaxial with the annular path of the fingers, the said annular member being supported on a stationary annular guide which has a central aperture for the passage of the groups of cigarettes from the discharge end of the feed unit to the entry end of the transfer channel.

The annular path of the gripping fingers is preferably circular, and the transfer path of the cigarettes, in other words the movement of the transfer elements and the transfer channel may be orientated substantially radially with respect to the circular path of the gripping fingers, and may advantageously extend from the central area of the circular annular path of the gripping fingers to the area which is radially directly behind the gripping fingers at the joining station with reference to the direction of transfer.

In a preferred embodiment, the paths of the groups of cigarettes on the feed unit, in the transfer channel and at the point of insertion together with the slips into the cells of the folding drum are contained within the same horizontal plane, while the cigarettes are orientated with their axes transverse with respect to the direction of movement along the said paths and parallel to the axis of the circular path of the gripping suction fingers. Additionally, the insertion movement of the groups of cigarettes together with the wrapping slips consists of a coaxial continuation of the transfer movement, and the passage from the feed unit to the linear transfer means takes place in the direction of the axis of the cigarettes.

BRIEF DESCRIPTION OF OTHER DRAWINGS

The invention also relates to other characteristics which further improve the packaging machine described above and which form the subject of the dependent claims.

The particular characteristics of the invention and the advantages derived therefrom will be more clearly understood from the description of a preferred embodiment, illustrated by way of example and without restriction in the attached drawings, in which.

DESCRIPTION OF THE PREFERRED EMBODIMENT OF THE INVENTION

Figure 1:
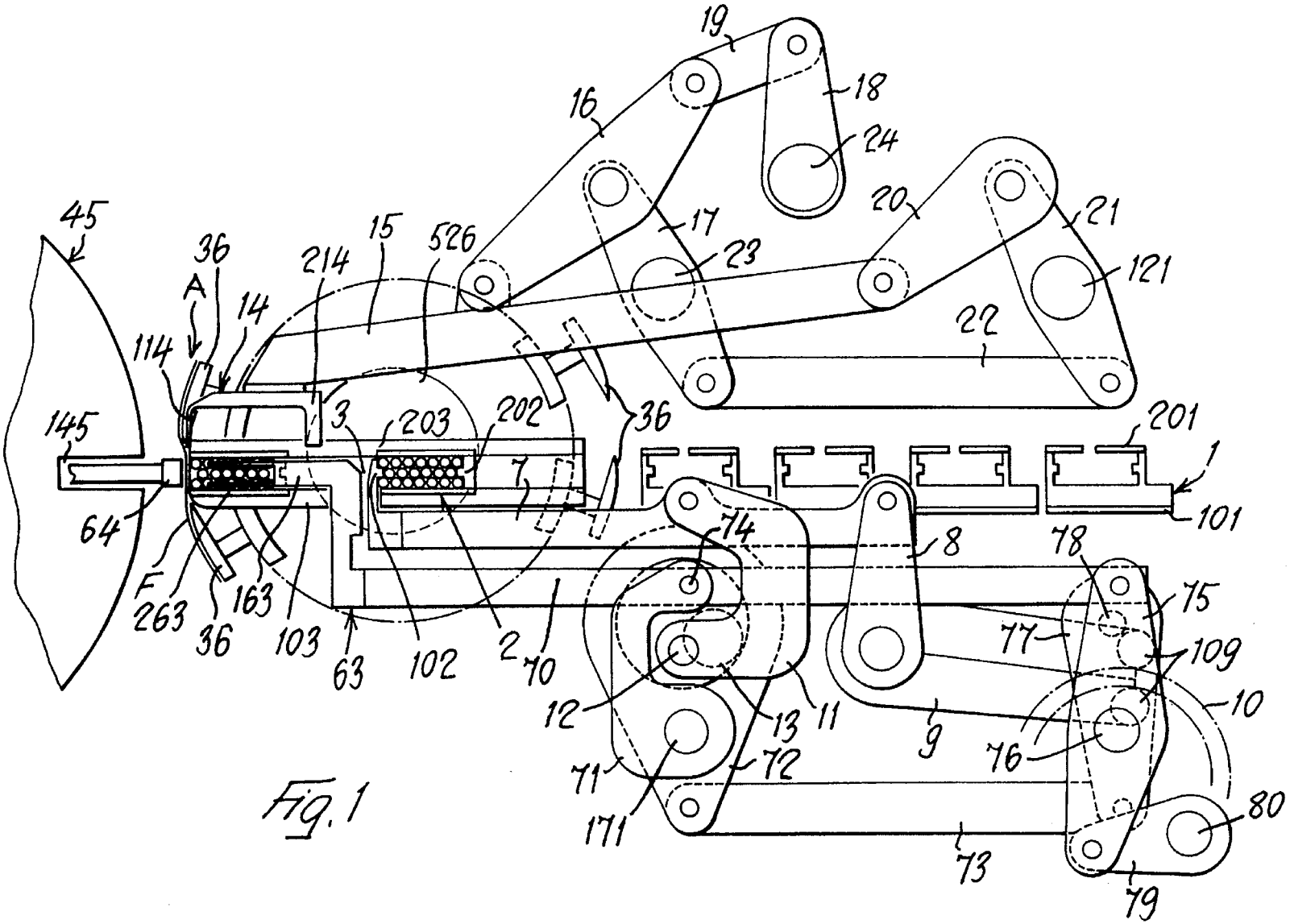
FIG. 1 is a schematic side view of the machine according to one embodiment of the invention.

With reference to the figures, a cigarette packing machine has a unit 1 for feeding ordered and predetermined groups of cigarettes which consists of a continuous conveyor belt 101, whose transporting arm is horizontal and carries a succession of tubular housings 201 spaced at equal intervals for the individual groups of cigarettes. The tubular housings 201 are open at their ends associated with the longitudinal edges of the conveyor belt 101 and are orientated with their axes transverse with respect to the belt, in other words to the direction of transport. The cigarettes are inserted axially into the tubular housings 201 with the axes of the cigarettes parallel to the axes of the housings. The conveyor belt 101 is driven in predetermined advancing steps, carrying the groups of cigarettes one after another to a position coinciding axially with a housing 2, at the entry end of a rectilinear transfer channel 3, which forms a transfer path which is rectilinear and coplanar with and in the direction of the continuation of the transport path of the groups of cigarettes on the feed unit 1. The rectilinear channel 3 interacts with transfer elements which execute a rectilinear movement inside the channel 3 and which propel the group of cigarettes from the entry end of the channel 3 to its discharge end next to a station A for joining to packaging slips F.

Figure 2:
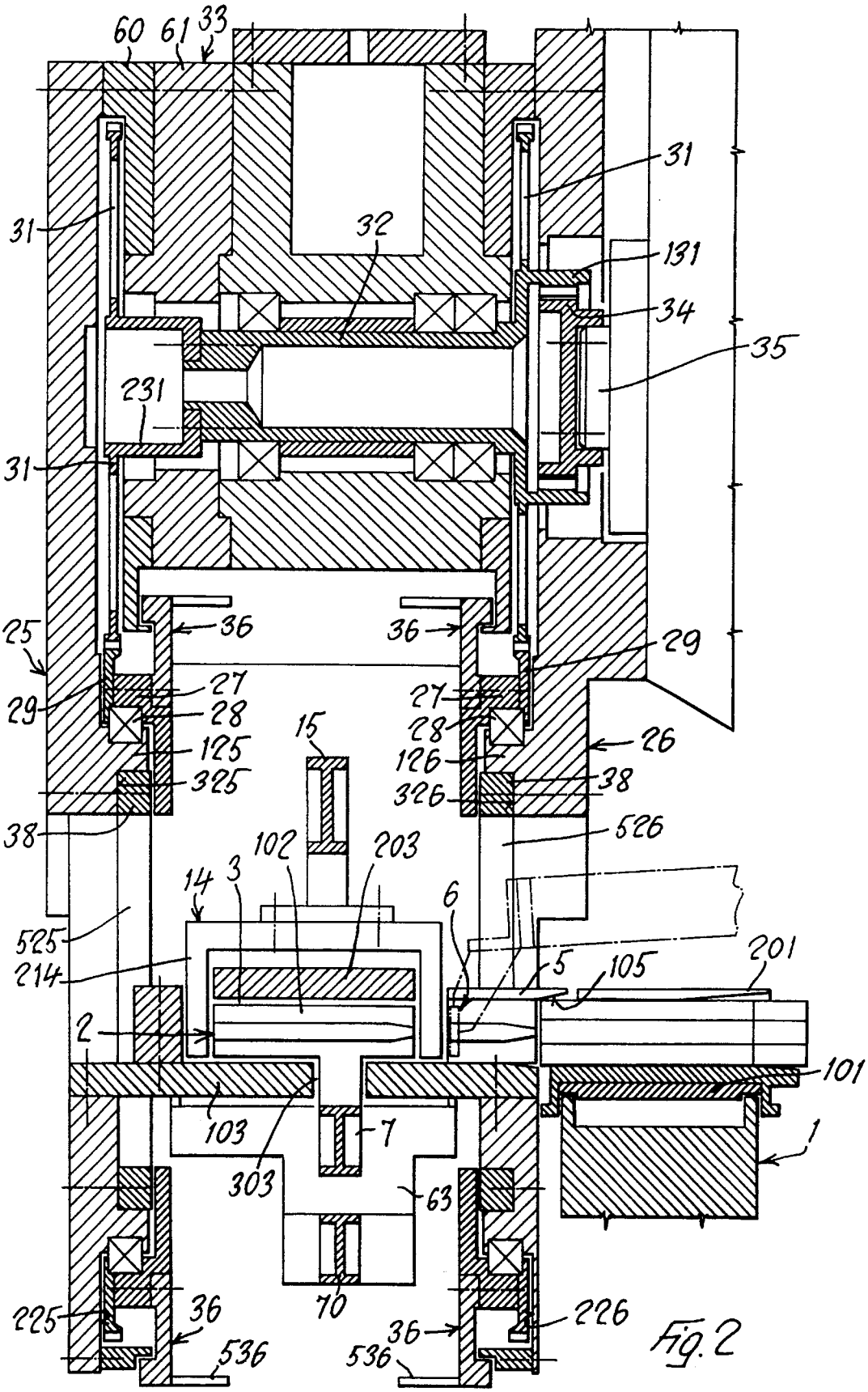
FIG. 2 is a section through the line II—II in FIG. 1.

The rectilinear transfer channel 3 is laterally out of alignment with the feed unit 1 and the tubular entry housing 2 has a transverse section corresponding to that of the tubular housings 201 of the feed unit 1. As shown in FIG. 2, a flared guide member 5, which is stationary and which has inclined flared surfaces 105 on its side facing the tubular housing 201, is provided between the tubular entry housing 2 of the transfer channel 3 and the coinciding tubular housing 201 of the feed unit 1. Each group of cigarettes is inserted into the tubular entry housing 2 of the transfer channel 3 by means of an axial pusher shown in broken lines in FIG. 2 and indicated by the number 6. The upper wall 203 and the lower wall 103 of the rectilinear transfer channel 3 are spaced apart so that they correspond substantially to the corresponding walls of the tubular housings 201 of the feed unit, and are extended to the rear to form the lower and upper walls of the tubular entry housing 2. Outside the tubular entry housing 2, the lower wall 103 of the transfer channel 3 consists of two lateral guides which engage only with the opposing ends of the cigarettes. The upper wall, however, is substantially complementary and vertically coinciding with the aperture interposed between the said two lateral guides forming the lower wall 103, so that the ends of the cigarettes, and in particular substantially the portion of the cigarettes resting on the lateral guides of the lower wall 103, project freely beyond the lateral edges of the said upper wall 203. As shown in FIG. 2, the lower wall 103 in the area of the tubular entry housing 2 is substantially continuous and has only one central slot 303 lying in the direction of transfer for the means of support of the front side wall 102 of the tubular entry housing 2, this slot being orientated in the axial direction of the cigarettes to enable the group of cigarettes to be moved in the direction of transfer; the said wall 102 is supported removably and can be moved along a substantially annular and rectangular path from a position in which it shuts off the entry housing 2 (FIGS. 1, 2) to a position in which it is lowered below the lower wall 103 of the transfer channel 3, in which position the entry housing 2 is open on its side facing the joining station A. The length of the front wall 102 is therefore slightly less than the distance between the lateral guides which form the lower wall 103 of the transfer channel 3 and coincides with the slot between these guides through which it passes from the position of shutting off the tubular entry housing 2 in the lowered condition in which the corresponding side of the housing is opened. The wall 102 is carried so that it projects vertically on a supporting bar 7 which forms part of a hinged system of levers. The bar 7 is orientated in the direction of transfer. It is hinged at its rear end to an oscillating lever 8 which rotates integrally with a fork 9 whose free end has a pair of rollers 109 of which one engages with the inside and one with the outside of a barrel cam 10. In an intermediate position the supporting bar 7 is hinged to an oscillating arm 11 whose other end is hinged to an eccentric crankpin 12. The oscillation of the oscillating lever 8 causes movement in the direction of the transfer movement, while the oscillation of the oscillating arm 11 substantially causes movement perpendicular to the direction of transfer. The crankpin 12 is disposed eccentrically with respect to a powered driving shaft 13, while the barrel cam 10 is also rotated by driving means. The opposite rear wall 202 of the entry housing 2 is however stationary and has a section corresponding to the rear section of the tubular housings 201 of the feed unit 1.

Each of the elements for transferring the group of cigarettes along the transfer channel 3 consists of a gripping head 14 which is formed by a pair of forks which are transverse with respect to the direction of transfer. The forks 114, 214 project freely towards the lower wall 103 of the transfer channel 3 and are spaced apart by a distance corresponding to the extension of the group of cigarettes in the direction of transfer. They are made in such a way that they engage the terminal areas of the ends of the cigarettes from the front and the rear at the front and rear ends of the group of cigarettes, the said areas being substantially vertically coincident with the guides which form the lower wall of the transfer channel 3, while the upper wall 203 of the channel 3 is engaged between the free arms of the forks 114, 214.

The gripping head 14 is driven in a two-dimensional, annular, substantially rectangular path, executing a rectilinear transfer movement parallel to the lower wall 103 of the transfer channel 3, a vertical raising movement to a position where there is no interference with the group of cigarettes, in other words through a distance greater than the vertical dimension of the group of cigarettes at the station for joining to the slip F, a return movement substantially parallel to the transfer movement, while still raised in the position where there is no interference with the group of cigarettes, and a lowering movement to a position of engagement of the group of cigarettes in the entry housing 2. For this purpose, the gripping head 14 is supported by and projects from a support bar 15 which is orientated in the direction of transfer of the groups of cigarettes and which forms part of a system of hinged operating levers. This system consists, in particular, of an articulated quadrilateral 16, 17, 18, 19 which is combined with an articulated parallelogram 15, 17, 20, 21, 22, the shafts 23 and 24 providing the rectilinear transfer and return movement and the transverse raising and lowering movement respectively, the shaft 121 being idle.

The transfer channel 3 is disposed in an intermediate position between two vertical plates 25 and 26 which are parallel to each other and orientated in the direction of the transfer of the groups of cigarettes. The two vertical plates 25 and 26 are carried on and project from the lower parts of the end walls of a box 33. Two annular circular supporting members 27, whose axes are orientated parallel to the axis of the folding drum, are supported in the plates 25 and 26 so that they can rotate freely and coaxially with respect to each other. The annular supporting members 27 are engaged so that they are freely rotatable 28 in annular coaxial guides 125, 126 which are integral with the facing inner walls of the plates 25, 26. An externally toothed ring 29 is fixed on the sides of the rotating annular supporting members 27 facing the corresponding plates 25, 26. The toothed rings 29 are housed in a corresponding annular channel 225, 226 in the plates 25, 26 whose radially inner walls are formed by the annular guides 125, 126 on which the annular supporting members 27 rotate. The annular channels 225, 226 are partially open over a predetermined portion on their radially outer upper part, and each of the rings 29 engages with an associated upper gear 31 which is vertically aligned with the corresponding toothed ring 29. The two gears 31 are housed in the upper box 33 and are fixed rotatably on the end of a hub 32 which is supported rotatably in the upper box 33. The gear on one inner end of the hub 32 is integral with a coaxial internally toothed ring 131 in which is engaged a gear 34 fixed on the free end of a driving shaft 35, in particular the output shaft of an oscillating/intermittent drive device with parallel axles, which is known, for example that produced by the Colombo Filippetti company of Casirate d'Adda (Bg).

Each of the rotatable annular members 27 carries, on its inner wall facing the other member, at least one and preferably more pairs, in particular two diametrically opposite pairs, of gripping suction fingers 36. The gripping suction fingers 36 of each pair are disposed at angular intervals corresponding to the length of the wrapping slip F (FIGS. 1 and 4), while the gripping fingers 36 associated with the two annular supporting members 27 are aligned with each other in the direction of the axis of the annular supporting members 27. As shown also in FIGS. 4 and 5, each gripping finger 36 has a radial supporting stem 136 which is fixed to the annular supporting member 27 by a base 236 which is elongated in the direction of the circumference of the annular supporting member 27. In particular, the base 236 is housed in a peripheral cavity 127, made in the form of a sector of an annulus, in the annular supporting members 27; the base being shaped so that it is complementary to the said cavity 127. The fixing may be done by any method, in particular by means of screws with flush-fitting heads, while it is possible to provide axial centring pins 227 which interact with centring holes 336 in the bases 236 of the gripping fingers 36. At the free end of the radial stem 136, each gripping finger 36 has an oblong suction head 436 which extends substantially tangentially and over a certain length, being slightly curved, with a radius of curvature different from, and in particular greater than, that of the circular path in which the gripping fingers 36 move. The radially outer surface of the oblong suction head has a projecting axial extension 536 on its inner side. The suction head 436 of each gripping finger 36 is extended in the direction of the circumference of the annular supporting members 27 in such a way that the two adjacent pairs of gripping fingers 36 designed to pick up a slip F form between them an aperture for the passage of the group of cigarettes into the joining station A. Each slip F is made to interact with a gripping finger 36 over a restricted lateral strip of limited length at each corner area of the slip.

Figure 5:
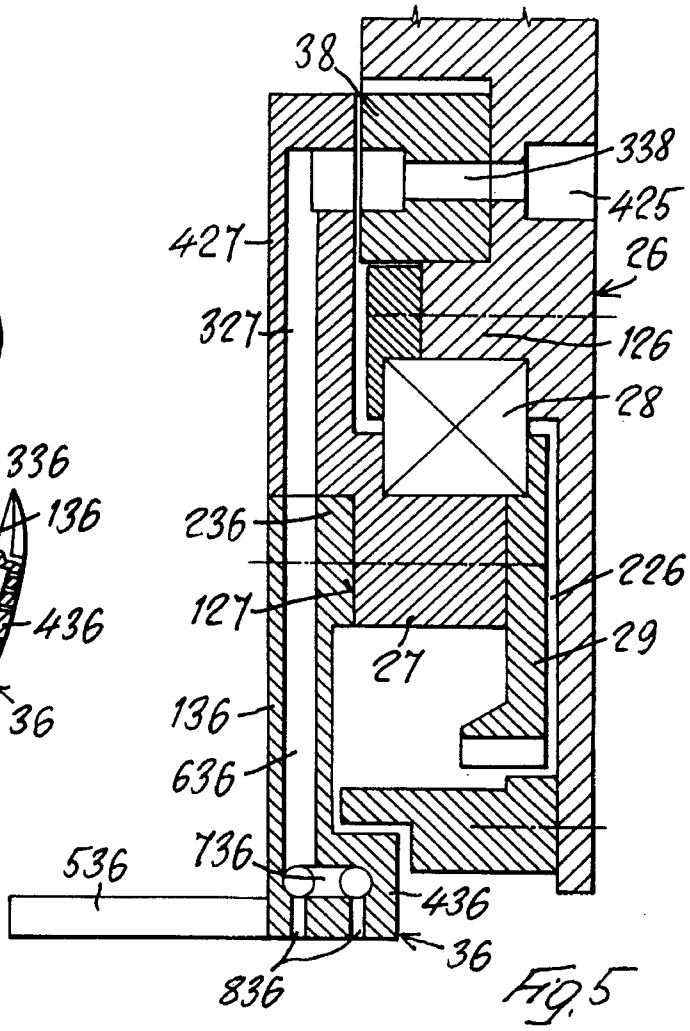
FIG. 5 is an enlarged detail of a gripping suction finger.
Figure 4:
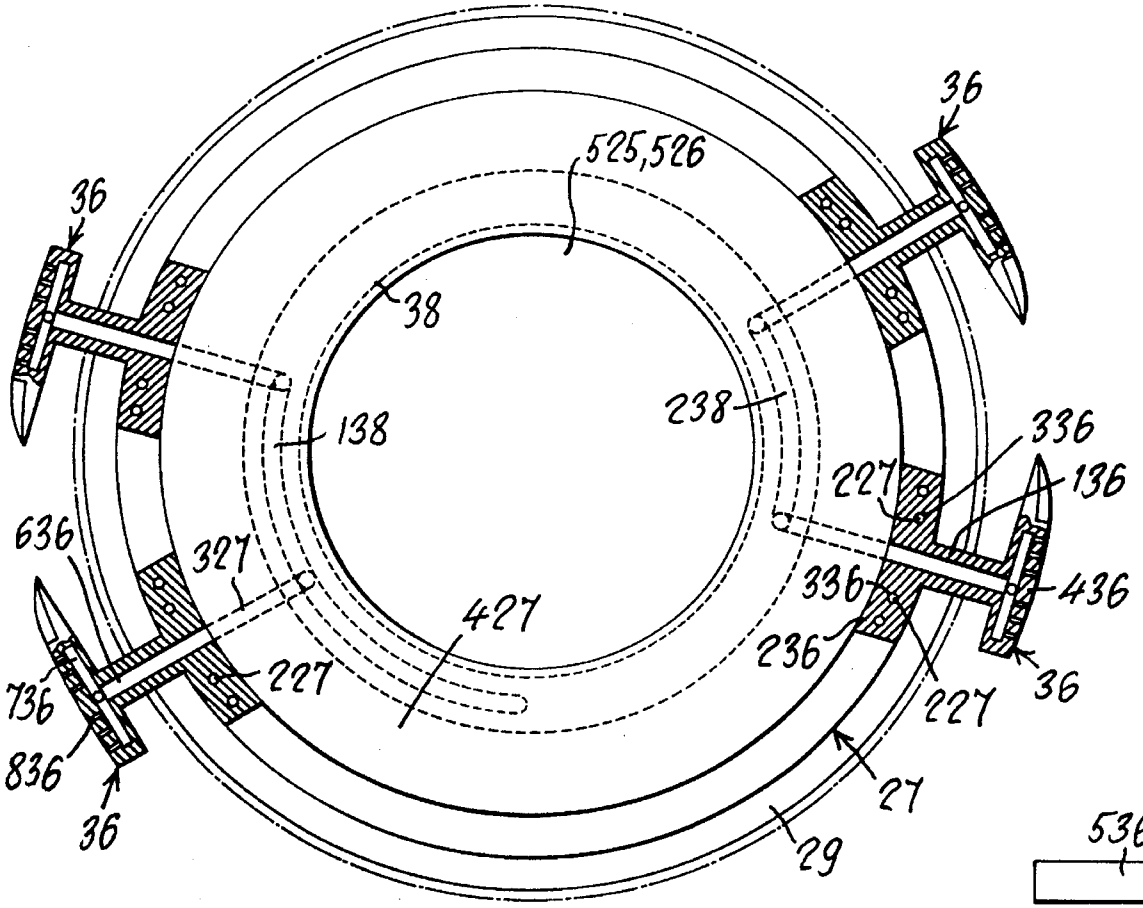
FIG. 4 shows the means of supporting, guiding and distributing the vacuum to the gripping suction fingers.

Each suction head 436 has an inner chamber 736 which communicates with a plurality of holes 836 distributed over the radially outer surface of the suction head 436, while on the other side it communicates with a radial duct 327 in the annular supporting member 27 through a duct 636 provided in the radial stem 136 of the gripping finger. The radial ducts 327 inside the annular supporting member 27 extend into a radially inner annular flange 427 of the annular supporting members 27, this flange 427 being superimposed on the inner end of the corresponding annular guide 125, 126, and extending radially beyond the inner perimeter of the annular guide 125, 126, in such a way that it is simultaneously super-imposed on a distributor ring 38 which is housed in an annular housing 325, 326 of the annular guides 125, 126, in such a way that it projects slightly beyond the corresponding end, bearing on the flange 427 to form a seal and being rotatable with respect to the flange. The distributor ring 38 is made of suitable material, for example graphite or similar. As shown in FIGS. 4 and 5, the radial ducts 327 of the annular supporting members 27 are open, on their sides which bear on the associated distributor ring 38, in a radial position such that they fall on the circumference along which grooves 138, 238 are provided, in the form of sectors of an annulus of predetermined length, in the facing side of the distributor ring 38. The grooves 138, 238 are disposed substantially diametrically opposite each other, and the first communicates with a vacuum source, while the second communicates with a source of compressed air, through at least one axial hole 338 in the distributor ring 38 which, on its opposite side, is connected to form a seal with a through hole 425, 426 in the corresponding plate 25, 26, and which is connected to the ducts 40, 41, 42 for connection to the vacuum source which is not illustrated, and to the ducts, which are also not illustrated, for connection to the source of compressed air.

The vacuum distribution groove 138 is disposed in such a position, and has such an angular size that, when the two annular supporting members 27 rotate simultaneously, the gripping fingers 36 are connected to the vacuum source successively from the position in which the slip is gripped by a feed unit, which is not illustrated and is disposed substantially up-line, to a position under the joining station A, with reference to the clockwise direction of rotation of the gripping fingers 36. The gripping fingers 36 remain connected to the vacuum source until they reach their position in which the slip F is correctly positioned with respect to the group of cigarettes at the joining station A (FIG. 1). The compressed air distribution groove 238 is disposed in a position substantially diametrically opposite the vacuum distribution groove 138, and the gripping fingers on the side diametrically opposite the joining station A are made to interact with the compressed air distribution groove. In this case, the compressed air is used to clean the ducts of the gripping fingers 36 in the non-operational position.

The above design has considerable advantages in respect of mounting and dismounting for maintenance purposes.

With reference to FIGS. 1, 2 and 4, it will be evident that there is a further advantage which consists in the possibility of disposing the entry housing 2 of the transfer channel 3 of the groups of cigarettes in the central area of the annular supporting members 27, at least the inner plate 26 and preferably also the outer plate 25 being provided with an aperture 425, 426 substantially coinciding with the central aperture of the annular guide 125, 126 or of the distributor ring 38 housed in the guide. The groups of cigarettes are then fed into the entry housing 2 of the transfer channel 3 through the said aperture 426. This makes it possible to shorten considerably the transfer movement of the groups of cigarettes from the entry housing 2 to the joining station A, making the construction of the transfer elements 14 less complicated and critical, and enabling higher operating speeds to be obtained.

Figure 8:
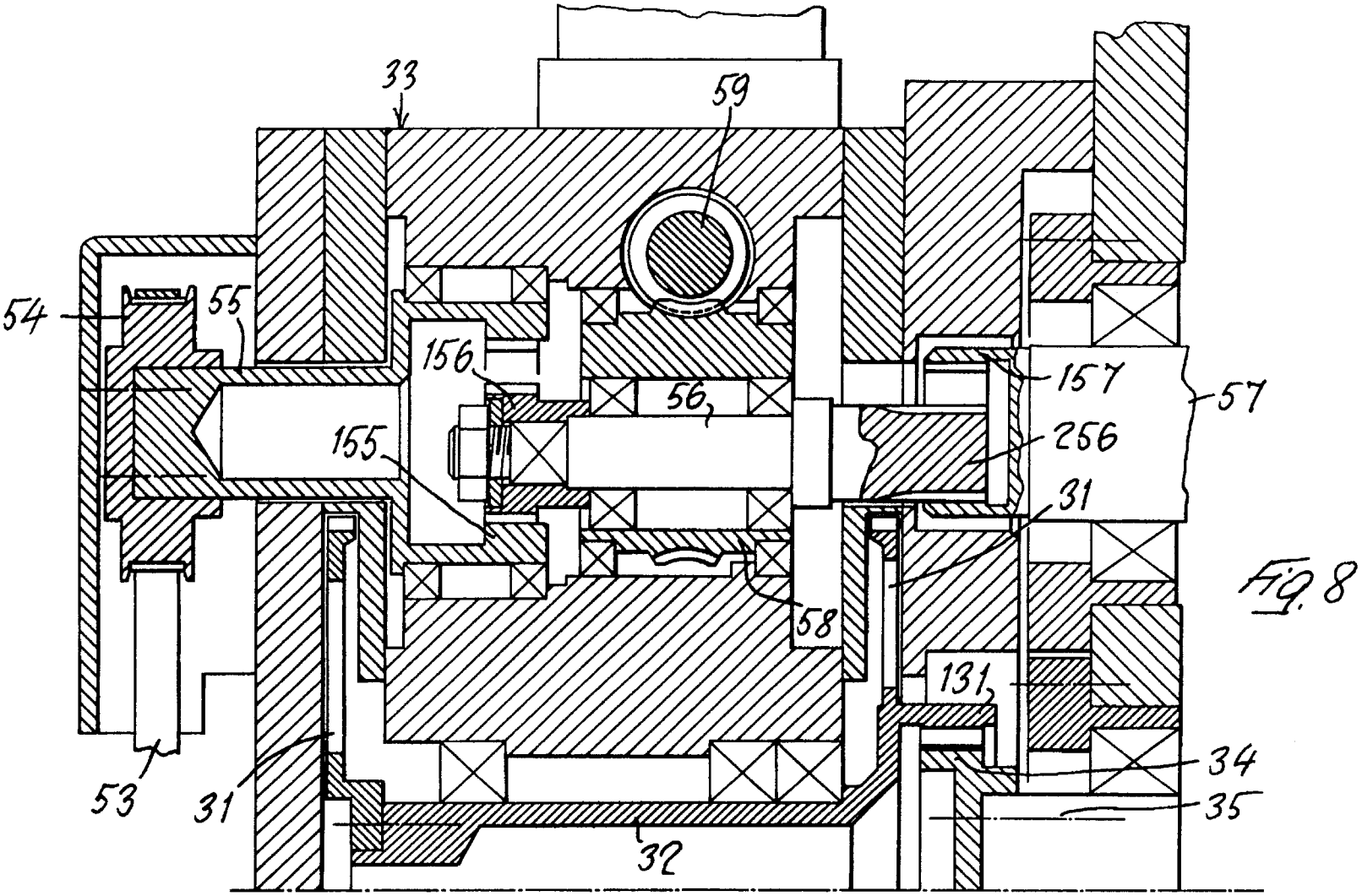
FIGS. 8 and 9 show a motorized valve for the distribution of the vacuum to the gripping suction fingers, to start and stop the suction in the station for joining the slips to the groups of cigarettes.
Figure 9:
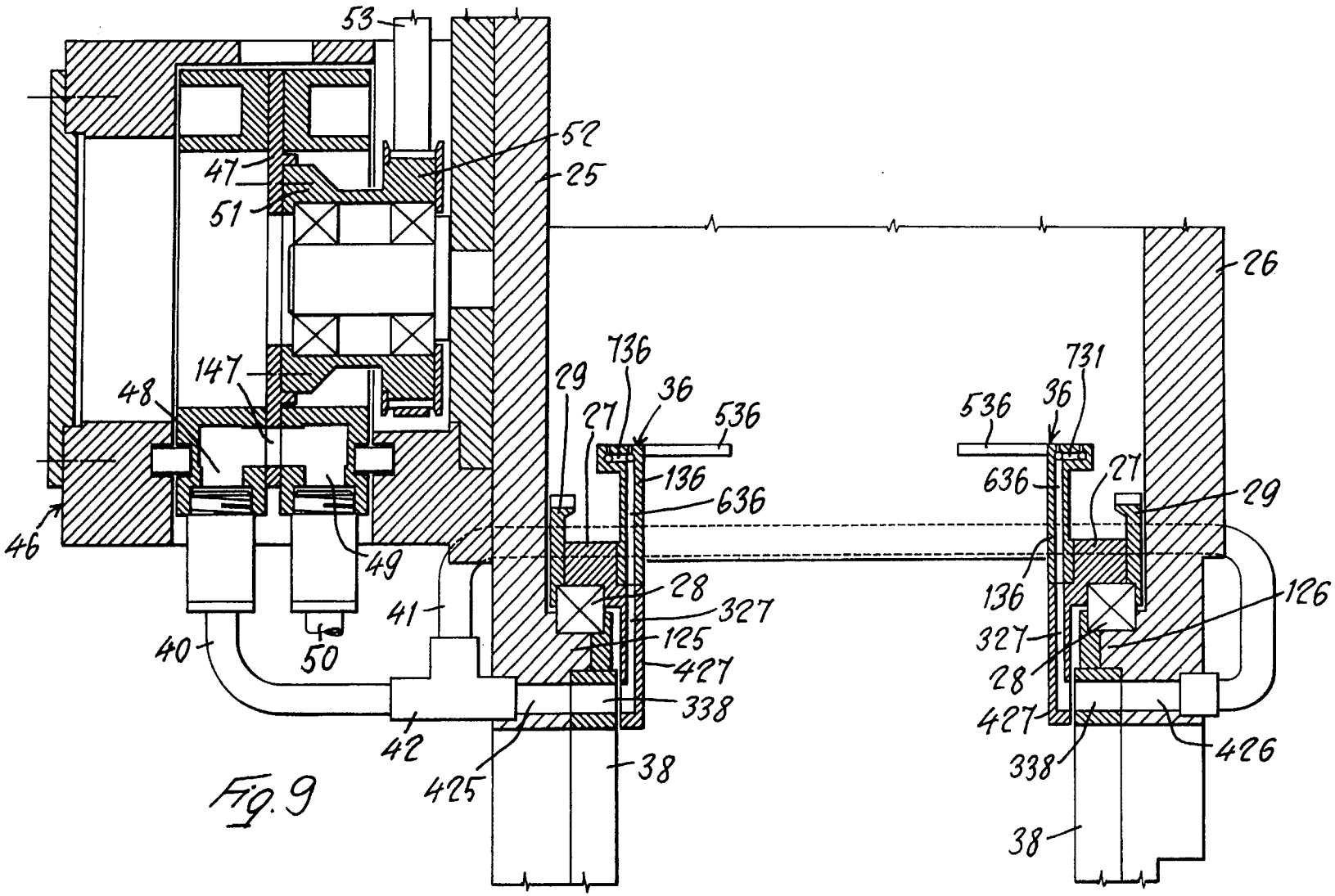

According to a variant shown in FIGS. 8 and 9, since the slip has to be detached from the gripping suction fingers 36 when the group of cigarettes together with the slip F is inserted into the cell 145 in the folding drum 45, a shut-off valve 46 is provided; this opens and closes, in a synchronized way, the connection of the distributor disc 38 to the vacuum source. The switch valve 46 is fixed outside the outer plate 25 and has a rotating shutter 47 consisting of a disc provided with an aperture 147. The disc 47 is interposed rotatably with respect to the same and with a seal between two chambers 48, 49, of which one 48 is connected by means of the ducts 40, 41, 42 to the vacuum distribution grooves 138 of both the distributor discs 38, while the other is connected by a duct 50 to the vacuum source. The shutter disc 47 is supported so that it is coaxially rotatable on the end of a hub 51 whose opposite end is integral with a coaxial pulley or sprocket 52 which is driven by means of a belt 53 running around a powered pulley or sprocket 54. This is driven in synchronization with the driving of the annular supporting members 27, means being provided for the fine adjustment of the synchronization in the forward or reverse direction.

With reference to FIG. 8, the powered pulley 54 is keyed to a shaft 55 which is supported so that it is freely rotatable about its axis and which terminates at its end in an internal ring gear 155. A further transmission shaft 56 has a pinion 156 at one end engaging eccentrically with the internal ring gear 155 of the shaft 55, and a pinion 256 at the other end engaging in the same eccentric way with an internal ring gear 157 rotating integrally with the output shaft 57 of an intermittent/oscillating drive device of the type similar to that driving the gears 31 which move the gripping fingers 36. The transmission shaft 56 is supported freely rotatably and eccentrically in a helical gear 58 which is also rotatable and which is engaged with an adjusting screw 59. The transmission ratios between the intermediate transmission shaft 56 and the output shaft 57 of the intermittent/oscillating drive device, and between the shaft 56 and the shaft 55, are set in such a way that, by turning the screw 59, the shaft 55 and therefore the driven pulley 54 is rotated with respect to the output shaft 57 of the intermittent/oscillating drive device.

Figure 7:
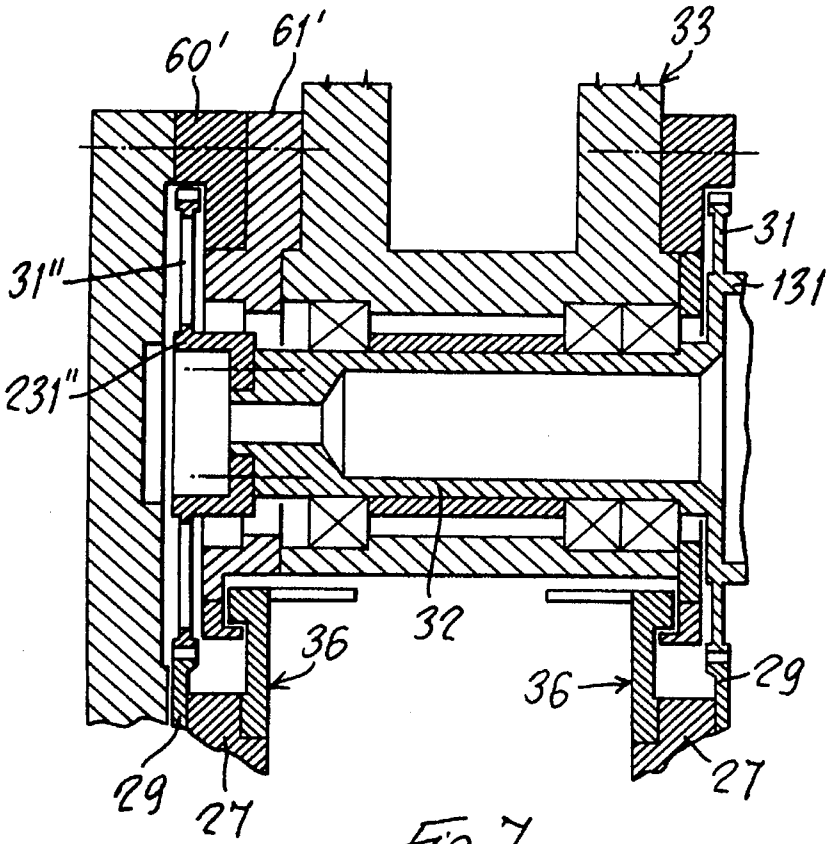
FIGS. 6 and 7 show a section similar to that shown in FIG. 2 of the detail of the means of operating the gripping fingers according to two variant embodiments adapted to cigarettes of two different lengths.
Figure 6:
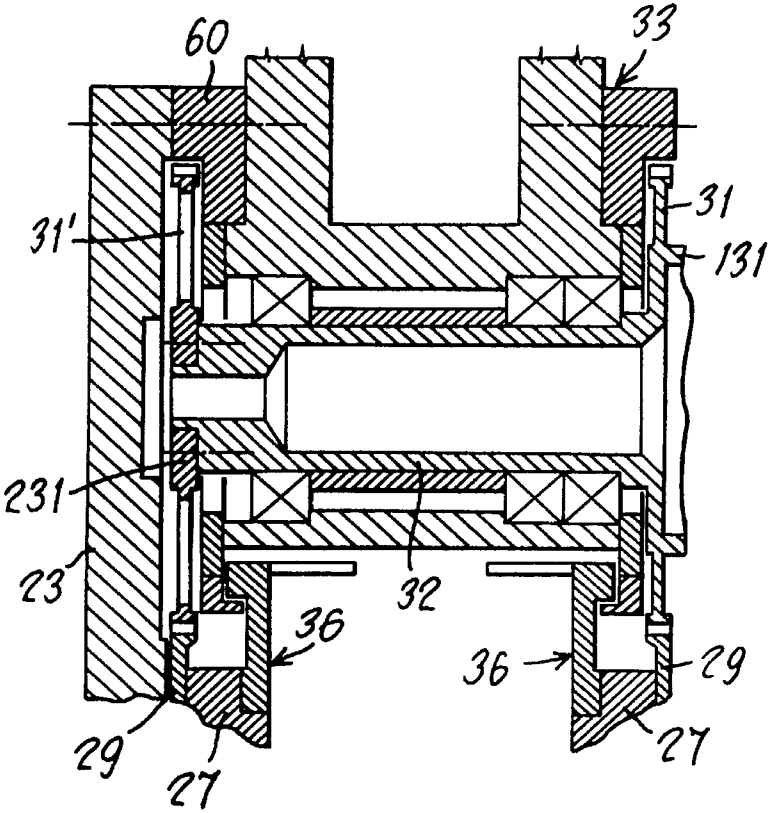

According to a further characteristic of the device, owing to the particular construction of the means of collecting and positioning the slips F it is possible to adapt the said means with extreme rapidity and simplicity to cigarettes of different lengths. This is shown, in particular, in FIGS. 2, 6 and 7. Since the annular supporting members 27 are not directly connected to each other mechanically, the outer plate 25 may be dismounted from the box 33 without dismounting the annular supporting member 27 associated with it, and without the need for any operation on either the inner plate 26 or on the associated annular member 27 or its driving means, namely the gear 31 and the driving shaft 32. In these conditions, the dismounting of the outer plate 25 provides access to the driving gear 31 of the associated annular supporting member 27 which can be easily dismounted from the end of the shaft 32. For adaptation to different lengths of cigarettes, it is therefore sufficient to provide axial extension pieces for the shaft 32 and pieces 60, 61, 60', 61' to space the plate 25 from the corresponding end of the box 33. The examples shown in FIGS. 2, 6 and 7 do not have an interchangeable extension for the shaft 32, but a set of gears 31, 31', 31" which differ from each other only in that they are or are not provided with different central axial extension hubs 231, 231', 231" which are integral with them on the side facing the associated end of the shaft 32, according to the length of the cigarettes. Consequently the gears 31, 31', 31" always have the same relative position of engagement with the ring 29 of the annular supporting members 27 associated with the outer plate 25. Similarly, the spacer pieces 60, 61, 60', 61' are made in such a way that individually or in combination with each other they hold the plate 25 at a distance corresponding to the gear 31, 31', 31" in use, and are shaped in such a way that they always form a housing of complementary size for the gear in the box 33.

For the insertion of the group of cigarettes together with the slip F into the cell 145 of the folding drum 45, there are provided a pusher 63 and a counter-pusher 64 which are operated in synchronization with each other and between which the group of cigarettes together with the slip F is held with a predetermined force at the joining station A. The counter-pusher 64 is of a known type and is in common use. The pusher 63, however, is made substantially similar to the removable wall 102 of the entry housing 2 of the transfer channel 3 and has an end 163 whose shape corresponds to that of the rear stationary wall of the entry housing 2 and of the housings 201 of the feed unit 1. The length of this feed unit in the direction of the axis of the cigarettes is slightly smaller than the distance between the lateral guides forming the lower wall 103 of the transfer channel 3, in such a way that the pusher head 163 can be moved in a reciprocating way between a position of interference with the group of cigarettes and a position outside and below the transfer channel 3. The path along which the pusher head 163 is moved comprises a rectilinear movement for insertion together with the counter-pusher 64, a first portion of return movement coinciding with the terminal portion of the insertion movement, a vertical lowering movement to below the lower wall 103 of the transfer channel 3, a further return movement to a position behind the group of cigarettes at the joining station A, and a vertical movement to a position coinciding with the rear end of the group of cigarettes at the joining station A. The pusher 63 is operated in a similar way to the front removable wall 102 of the entry housing 2 by means of a system of articulated levers. In particular, the pusher 63 is carried by and projects from a bar 70 orientated in the direction of insertion. This bar is hinged at an intermediate point to an arm 71 which is hinged to an intermediate point 171 of an oscillating lever 72, one of whose ends is hinged to a connecting bar 73, while the other is engaged in a freely rotatable way eccentrically 74 with respect to a driving shaft 13 which is also connected to the arm 11 of the system of operating levers of the removable front wall 102 of the entry housing 2. The rear end of the supporting bar 70 is hinged to a further arm 75 which is hinged at an intermediate position 76 to a driven lever 77 keyed at one end to a driving shaft 78. The opposite end of the driven lever 77 is hinged to the connecting bar 73, while the other end of the arm 75 is hinged to a lever 79 oscillating freely about a stationary axis 80. In this case, the shaft 78 substantially causes the pusher 63 to move in the direction of insertion and return, while the shaft 13 provides its raising and lowering movement. According to a further characteristic, the pusher head 163 has fingers on each side, particularly in the form of a fork 263, which laterally overlap the ends of the cigarettes at the joining station A, in such a way that they also hold the cigarettes axially during the insertion into the cell 162 of the folding drum 62.

Figure 3:
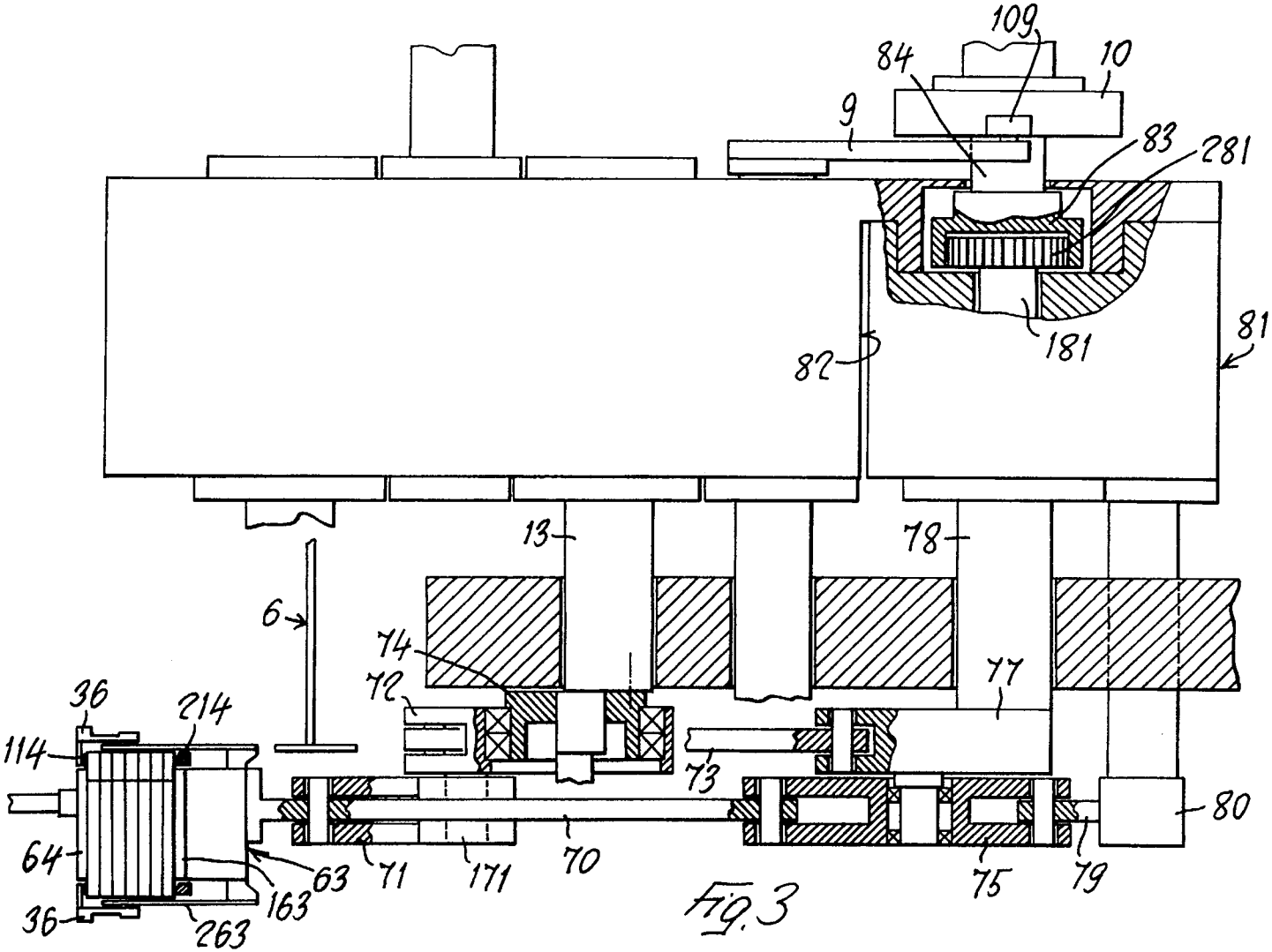
FIG. 3 shows the linear transfer means, in partial section.

The operation of the feed unit 1, the axial pusher elements 6, the transfer elements 14, the removable wall 102 of the entry housing 2 of the transfer channel, the pusher 63 and the counter-pusher 64, and also the gripping fingers 36, is synchronized. In particular, the synchronization takes place mechanically with the aid of a plurality of intermittent/oscillating drive devices of the type indicated previously which take their motion from at least one common driving motor. For handling groups of cigarettes with different transverse extensions with respect to their axes, for the formation of packs with more or fewer cigarettes, it is necessary to change the insertion movement and the position of the removable front wall 102 of the entry housing 2 of the transfer channel 3. According to an advantageous characteristic of the invention, shown in FIG. 3, the driving shafts 13 and 78 consist of the output shafts of oscillating/intermittent drive devices, in particular devices with parallel axles, which are fitted in suitable housings in the front wall of the machine from which they project. In particular, the intermittent/oscillating drive device 81, whose output shaft 78 produces the insertion and return movement of the pusher 63, is housed removably in a recess 82, and its input shaft 181 has a gear 281 engaged with a coaxial internal ring gear 83, the said input shaft 181 being orientated parallel to the output shaft 78 and in the direction of the removal of the intermittent/oscillating drive device 81. By means of this arrangement, the movement of the pusher 63 can be varied simply by replacing the oscillating/intermittent drive device 81, designed to produce oscillations of the output shaft 78 through a predetermined angle, with an identical oscillating drive device designed for a different angular size of oscillation matched to the different movement of the pusher 63. The internal ring gear 83 is integral with the free end of a transmission shaft 84 connected mechanically to the main motor, directly or through further oscillating/intermittent drive devices, or similar synchronizing elements. The transmission shaft 84 advantageously also rotates the cam 10 which produces the movement in the direction of transfer of the groups of cigarettes and in the opposite direction of the removable front wall 102 of the entry housing 2 of the transfer channel 3. Consequently, the movement of the latter may also be varied simply by replacing the cam 10 with a cam having a profile corresponding to the desired variation of movement. The cam 10 is directly accessible for its replacement by removing the base wall of the housing recess 82 of the oscillating/intermittent drive device 81 which drives the pusher 63. The elements 14 for transferring the groups of cigarettes along the transfer channel are adaptable to the different dimensions of the group of cigarettes in the direction of transfer, simply by replacing the gripping head.

Naturally, the invention is not limited to the embodiments described and illustrated herein, but may be widely varied and modified, especially in respect of construction, without departure from the guiding principle described above and claimed below.

We claim:

1. A machine for packaging fragile cylindrical products, particularly cigarettes, comprising:

a unit for feeding a succession of ordered groups of cigarettes;

a drum for folding wrapping slips around a group of cigarettes, this drum being provided with at least one peripheral cell, each of which houses one group of cigarettes and has a peripheral opening for the insertion of a group of cigarettes;

a station for joining a wrapping slip to a group of cigarettes, in which station the group of cigarettes is disposed in a position coinciding with and in front of the open side of the associated cell and the wrapping slip is interposed between the open insertion sider of the cigarette-carrying cell and the facing side of the group of cigarettes;

means for collecting the wrapping slip and positioning it in a predetermined position, substantially parallel to the facing sides of the group of cigarettes and of the cigarette-carrying cell;

means for gripping the group of cigarettes and inserting it, together with the wrapping slip, into the cigarette-carrying cell;

means for transferring the group of cigarettes from the unit for feeding the succession of groups of cigarettes to the station for joining them to the wrapping slips;

means for synchronized operation of the said feed unit and the said collecting/positioning, gripping/inserting and transferring means, characterized in that the means for collecting and positioning the wrapping slips have at least two pairs of gripping suction fingers which are supported movably together along an annular path about at least one axis parallel to the axis of the folding drum, and which have a fixed relative disposition such that each of them interacts with one lateral face of the slip at one of the front and rear ends of the slip with respect to the direction of movement of the fingers along the annular path;

the means for transferring the cigarettes from the feed unit to the joining station are made in such a way that the transfer path of the groups of cigarettes is at least partially rectilinear.

2. Machine according to claim 1, characterized in that the rectilinear transfer path of the groups of cigarettes is transverse with respect to the axis of the path of the gripping suction fingers, and is a secant of this axis.

3. Machine according to claim 1, characterized in that the gripping fingers are fitted on guide and support means which laterally surround an intermediate transfer channel interposed between the fingers associated with the two opposite lateral strips of the wrapping slips; this transfer channel opens onto the open insertion sides of the cigarette-carrying cells at the joining station, and is orientated in the direction of insertion of the groups of cigarettes together with the wrapping slips into the said cells, while the transfer channel is associated with linear transfer elements which are moved along the said transfer channel, with a reciprocating motion along an annular two-dimensional rectangular path, in other words with rectilinear transfer and return movements and transverse raising and lowering movements.

4. Machine according to claim 1, characterized in that the rectilinear transfer path of the groups of cigarettes is advantageously coplanar, and laterally out of alignment, with the transport path of the groups of cigarettes on the feed unit, pushing means being provided to move the groups of cigarettes from the discharge end of the feed unit to the entry end of the transfer channel along a path transverse with respect to the said transfer channel and to the direction of transport on the feed unit.

5. Machine according to claim 1, characterized in that the entry end of the transfer channel is disposed substantially in the median area of the annular path of the gripping fingers, the guide and support means of the gripping fingers consisting, at least on the side facing the feed unit, of an annular member which is coaxial with the annular path of the fingers and is supported on a stationary annular guide which has a central aperture for the passage of the groups of cigarettes from the discharge end of the feed unit to the entry end of the transfer channel.

6. Machine according to claim 1, characterized in that the annular path of the gripping fingers is circular, and the transfer path of the cigarettes, in other words the movement of the transfer elements and the transfer channel may be orientated substantially radially with respect to the circular path of the gripping fingers, and extends from the central area of the circular annular path of the gripping fingers to the area which is radially directly behind the gripping fingers at the joining station with reference to the direction of transfer.

7. Machine according to claim 1, characterized in that the paths of the groups of cigarettes on the feed unit, in the transfer channel and at the point of insertion together with the slips into the cells of the folding drum are contained within the same horizontal plane, while the cigarettes are orientated with their axes transverse with respect to the direction of movement along the said paths and parallel to the axis of the circular path of the gripping suction fingers, and while the insertion movement of the groups of cigarettes together with the wrapping slips consists of a coaxial continuation of the transfer movement, and the passage from the feed unit to the transfer channel takes place in the direction of the axis of the cigarettes.

8. Machine according to claim 1, characterized in that on each longitudinal side of the transfer channel there is provided two pairs diametrically opposed to each other with respect to the axis of their circular path, the pairs of gripping fingers on both sides of the transfer channel being aligned with each other in a direction transverse with respect to the direction of transfer, while the gripping fingers of each pair are spaced apart angularly in a fixed way corresponding to the dimensions of the slip, in the direction of the circular path of the gripping fingers and by an amount such that they form an aperture between them for the passage of the groups of cigarettes, the support and guide means for the gripping fingers on both sides of the transfer channel being independent of each other and mountable on and dismountable from the machine frame independently of each other and being assembled in the operating condition as a modular operating unit.

9. Machine according to claim 8, characterized in that the gripping fingers on each side of the transfer channel are driven together by common transmission means which are supported on the machine in such a way that they can be independently mounted on and dismounted from the guide and support means of the gripping fingers.

10. Machine according to claim 8, characterized in that each of the supporting means of the gripping fingers on each side of the transfer channel consists of a circular annular supporting member mounted rotatably on an annular guide provided in the area projecting from the lower part of a supporting plate which laterally overlaps the corresponding side of the transfer channel, while each annular supporting member is connected mechanically to a common transmission shaft driven in synchronization with the feed unit, the transfer elements and the means for the insertion of the groups of cigarettes into the cells of the folding drum, and also with the folding drum.

11. Machine according to claim 10, characterized in that the supporting plates form the ends of a box-shaped housing disposed above the transfer channel for the transmission shaft and the means of operative connection of the transmission shaft to the annular supporting members, and can be mounted and dismounted together with the annular supporting members mounted on them in the operating position.

12. Machine according to claim 8, characterized in that each of the gripping fingers has a suction head whose radially outer surface is orientated substantially tangentially to the annular supporting member, while the said suction head has a vacuum/pressure chamber which has a plurality of holes opening onto the radially outer surface of the suction head and which communicates, through a duct in a supporting stem of the gripping fingers and a coinciding duct in the annular supporting member, alternately with a vacuum source and a pressure source, by means of a stationary distributor ring which has grooves in the form of sectors of an annulus; the entry ends of the ducts provided in the annular supporting members open with a seal into these grooves and move along them during the rotation of the supporting members, the grooves of predetermined angular size being disposed diametrically opposite each other with one in the area of the joining station, one communicating with a vacuum source and the other with a pressure source.

13. Machine according to claim 12, characterized in that the distributor rings are mounted permanently in the corresponding supporting plates of the annular members and can be mounted and dismounted together with the corresponding plates.

14. Machine according to claim 12, characterized in that the vacuum distribution groove is connected to the vacuum source, by means of a valve with a rotary shutter, this valve being operated in synchronization with the operation of the gripping fingers, while means are provided for the manual forward or backward adjustment.

15. Machine according to claim 1, characterized in that means are provided for the spacing in the direction of the axis of the cigarettes, of the support and guide means of the gripping fingers on the outer side of the transfer channel, the spacing means being matched singly or in combination to the different predetermined axial lengths of the cigarettes, while means of extending the transmission shaft are also provided for coupling to the means of operational connection to the supporting member of the said gripping fingers on the outer side of the transfer channel.

16. Machine according to claim 15, characterized in that the shaft for transmitting the rotary motion to the supporting members of the gripping fingers is parallel to the axis of rotation of the said annular supporting members and has, in a position vertically coinciding with an externally toothed ring which is fixed coaxially to each annular supporting member, a gear which is engaged with the toothed ring and which is fixed to the corresponding end of the said transmission shaft, while gears with a central hub for connection to the end of the transmission shaft, each having a different axial projection on the side for fixing to the transmission shaft, are provided, one for each different axial spacing of the annular supporting member for the gripping fingers on the outer side of the transfer channel from the annular supporting member for the fingers on the opposite side of the channel.

17. Machine according to claim 1, characterized in that means are provided to push the group of cigarettes together with the slip from the joining station into the cell of the folding drum, the length of the movement of these means being determined by the driving movement of a transmission unit, the said transmission unit being mounted removably and replaceably, and being provided with removable means of coupling to the driving shaft of the unit, to enable the movement of the pusher to be varied in accordance with the different standard dimensions of the groups of cigarettes in the direction of transfer.

18. Machine according to claim 1, characterized in that the transfer channel has an entry end with a tubular housing for the group of cigarettes orientated with its axis transverse with respect to the direction of transfer, and in that it is provided with a front wall which can be moved alternately between a position of closing the said entry housing and a position of opening the said front end of the housing, means of driving the said removable front wall being provided and being interchangeable for adaptation to the different dimensions of the group of cigarettes in the direction of transfer, while the opposite rear wall is stationary and the remaining upper and lower walls consist of extensions of the upper and lower walls of the transfer channel.

19. Machine according to claim 18, characterized in that the means of driving the removable front wall are disposed behind or in front of the transmission unit associated with the pusher and are driven by the same shaft.

20. Machine according to claim 1 characterized in that each of the transfer elements has a gripping head provided with front and rear forks which engage from above the terminal portions of the ends of the cigarettes at the front and rear of a group of cigarettes in the transfer channel, the transfer channel being made in such a way that the said ends of the cigarettes project laterally beyond it for a distance corresponding to the prongs of the forks while the gripping head and the transfer channel interpenetrate without mutual interference and the said head is movable parallel to the transfer channel into the said position of interpenetration and gripping of the group of cigarettes at least during the transfer movement, the gripping head being replaceable with others suitably adapted to interact with groups of cigarettes having different dimensions in the direction of transfer.

* * * * *